US005746078A

United States Patent [19]

Kiernan

[11] Patent Number: 5,746,078

[45] Date of Patent: May 5, 1998

[54] PROTECTION DEVICE FOR KEY LOCK OPENINGS

[76] Inventor: Mark Kiernan, 19 Anne C.T., Bramalea, Ontario, Canada, L6T 1K2

[21] Appl. No.: 762,276

[22] Filed: Dec. 9, 1996

[51] Int. Cl.[6] ..... E05B 13/02; E05B 17/14

[52] U.S. Cl. ..... 70/424; 70/276; 70/413; 70/455

[58] Field of Search ..... 70/455, 423–428, 70/276, 413

[56] References Cited

U.S. PATENT DOCUMENTS

| | | | |
|---|---|---|---|
| 83,837 | 11/1868 | Davies | 70/424 |
| 1,405,368 | 1/1922 | Warren | 70/455 |
| 1,846,078 | 2/1932 | Behrendt | 70/424 |
| 2,988,910 | 6/1961 | Eshbaugh et al. | 70/455 |
| 3,434,318 | 3/1969 | Thiry | 70/455 |
| 3,861,182 | 1/1975 | Skinner | 70/455 |
| 4,118,962 | 10/1978 | Block et al. | 70/455 |
| 4,297,863 | 11/1981 | Glock | 70/455 X |
| 4,638,652 | 1/1987 | Morse et al. | 70/455 X |
| 4,858,454 | 8/1989 | McAnulty, III | 70/455 |
| 5,205,144 | 4/1993 | Montano | 70/455 |

FOREIGN PATENT DOCUMENTS

| | | | |
|---|---|---|---|
| 22806 | 1/1906 | Austria | 70/423 |
| 698202 | 1/1931 | France | 70/424 |
| 322182 | 6/1920 | Germany | 70/424 |
| 1902467 | 10/1970 | Germany | 70/455 |
| 2710842 | 9/1978 | Germany | 70/455 |
| 3716370 | 11/1988 | Germany | 70/455 |

*Primary Examiner*—Lloyd A. Gall

[57] ABSTRACT

A new Protection Device For Key Lock Openings for preventing moisture and dirt from entering key locks. The inventive device includes a dome-shaped cap, a handle on one side of the cap, and a magnetized clip extending from the other side of the cap and sized to fit within a key lock opening.

10 Claims, 3 Drawing Sheets

PROTECTION DEVICE FOR KEY LOCK OPENINGS

BACKGROUND OF THE INVENTION

1. Field of the Invention

The present invention relates to key lock covers and more particularly pertains to a new Protection Device For Key Lock Openings for preventing moisture and dirt from entering key locks.

2. Description of the Prior Art

The use of key lock covers is known in the prior art. More specifically, key lock covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art key lock covers include U.S. Pat. No. 4,282,732; U.S. Pat. No. 4,825,673; U.S. Pat. Des. 333,083; U.S. Pat. No. 3,861,182; U.S. Pat. No. 4,090,379 and U.S. Pat. No. 4,858,454.

While these devices fulfill their respective, particular objectives and requirements, the aforementioned patents do not disclose a new Protection Device For Key Lock Openings. The inventive device includes a dome-shaped cap, a handle on one side of the cap, and a magnetized clip extending from the other side of the cap and sized to fit within a key lock opening.

In these respects, the Protection Device For Key Lock Openings according to the present invention substantially departs from the conventional concepts and designs of the prior art, and in so doing provides an apparatus primarily developed for the purpose of preventing moisture and dirt from entering key locks.

SUMMARY OF THE INVENTION

In view of the foregoing disadvantages inherent in the known types of key lock covers now present in the prior art, the present invention provides a new Protection Device For Key Lock Openings construction wherein the same can be utilized for preventing moisture and dirt from entering key locks.

The general purpose of the present invention, which will be described subsequently in greater detail, is to provide a new Protection Device For Key Lock Openings apparatus and method which has many of the advantages of the key lock covers mentioned heretofore and many novel features that result in a new Protection Device For Key Lock Openings which is not anticipated, rendered obvious, suggested, or even implied by any of the prior art key lock covers, either alone or in any combination thereof.

To attain this, the present invention generally comprises a dome-shaped cap, a handle on one side of the cap, and a magnetized clip extending from the other side of the cap and sized to fit within a key lock opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Protection Device For Key Lock Openings apparatus and method which has many of the advantages of the key lock covers mentioned heretofore and many novel features that result in a new Protection Device For Key Lock Openings which is not anticipated, rendered obvious, suggested, or even implied by any of the prior art key lock covers, either alone or in any combination thereof.

It is another object of the present invention to provide a new Protection Device For Key Lock Openings which may be easily and efficiently manufactured and marketed.

It is a further object of the present invention to provide a new Protection Device For Key Lock Openings which is of a durable and reliable construction.

An even further object of the present invention is to provide a new Protection Device For Key Lock Openings which is susceptible of a low cost of manufacture with regard to both materials and labor, and which accordingly is then susceptible of low prices of sale to the consuming public, thereby making such Protection Device For Key Lock Openings economically available to the buying public.

Still yet another object of the present invention is to provide a new Protection Device For Key Lock Openings which provides in the apparatuses and methods of the prior art some of the advantages thereof, while simultaneously overcoming some of the disadvantages normally associated therewith.

Still another object of the present invention is to provide a new Protection Device For Key Lock Openings for preventing moisture and dirt from entering key locks.

Yet another object of the present invention is to provide a new Protection Device For Key Lock Openings which includes a dome-shaped cap, a handle on one side of the cap, and a magnetized clip extending from the other side of the cap and sized to fit within a key lock opening.

Still yet another object of the present invention is to provide a new Protection Device For Key Lock Openings that is safe for locks and easy to use.

Even still another object of the present invention is to provide a new Protection Device For Key Lock Openings that eliminates the use of heating devices to de-ice lock mechanisms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
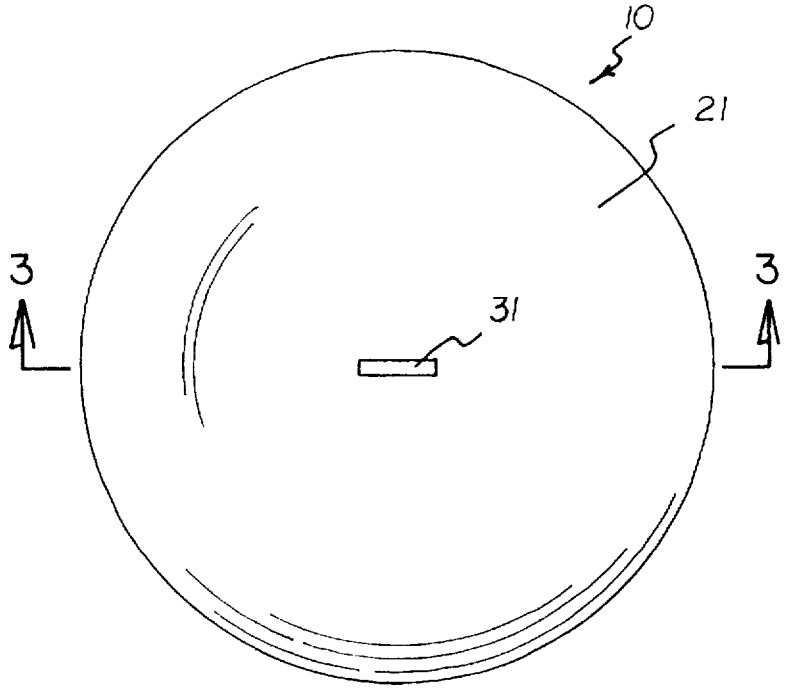
FIG. 1 is a top view of a new Protection Device For Key Lock Openings according to the present invention.
Figure 2:
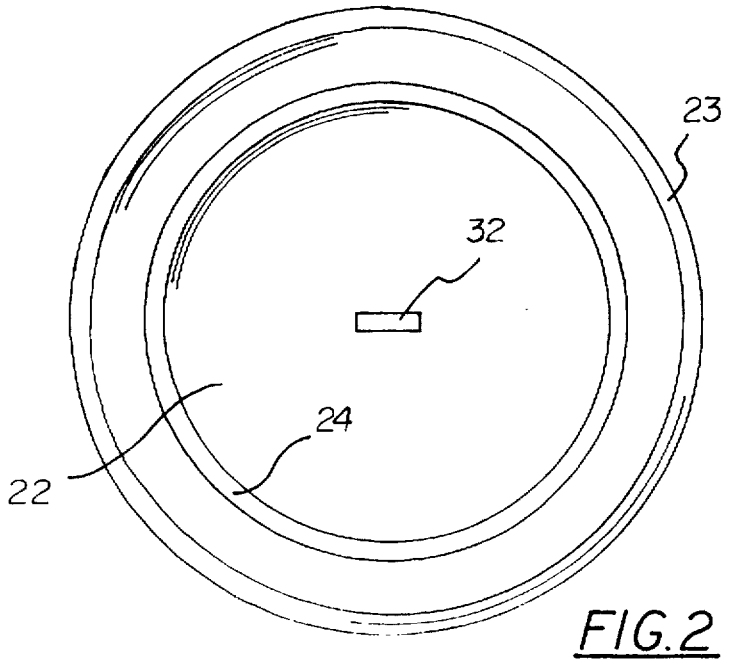
FIG. 2 is a bottom view thereof.

With reference now to the drawings, and in particular to FIGS. 1 through 4 thereof, a new Protection Device For Key Lock Openings embodying the principles and concepts of the present invention and generally designated by the reference numeral 10 will be described.

More specifically, it will be noted that the Protection Device 10 for key lock openings comprises a cap 20 and a one-piece handle and clip assembly 30.

Figure 3:
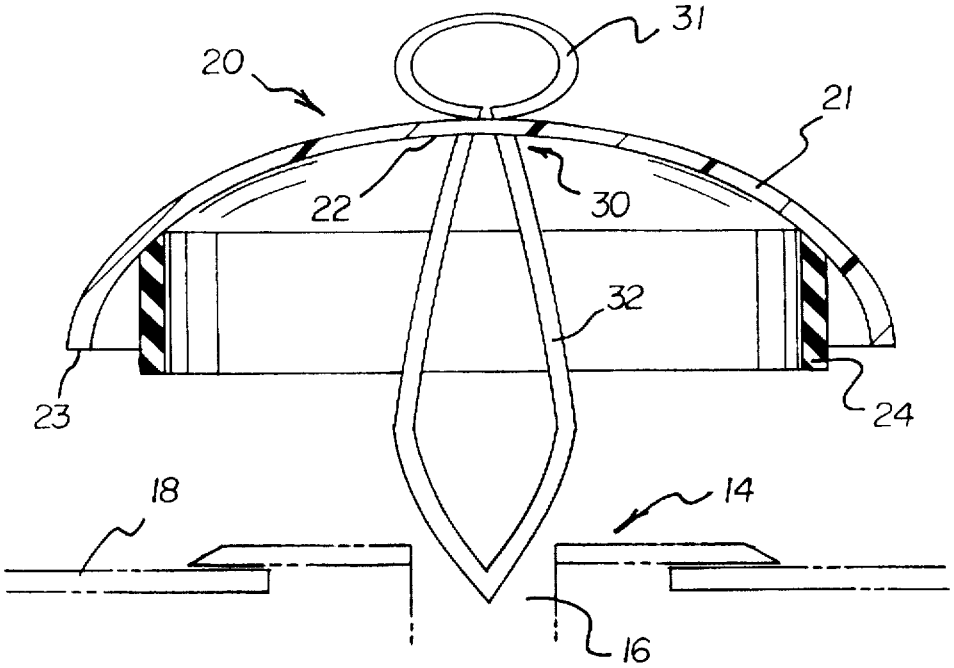
FIG. 3 is a cross sectional view taken along line 3—3 of FIG. 1.

As best illustrated in FIGS. 1 through 4, it can be shown that the device 10 is utilized with key operated locking mechanisms, such as those on cars and trucks. As best shown in FIG. 3, a car or truck includes a lock mechanism 14 with a key hole 16, affixed to an exterior panel or surface 18 of the vehicle.

The device 10 includes a cap 20 which is sized to fit around the lock mechanism 14. The cap 20 includes an exterior convex surface 21, an interior concave surface 22, and a bottom surface 23, to give the cap an overall dome-shaped appearance. The bottom surface 23 is made flat so as to closely engage with the panel 18. The cap is made of rigid plastic material.

Extending from the concave surface 22 is a sealing ring 24. The ring 24 is sized such that it surrounds the locking mechanism 14, and so that it extends past the bottom surface 23 of the cap 20. This provides increased sealing effect when the bottom surface 23 is disposed in contact with the panel 18, thus preventing moisture from entering the locking mechanism 14. The sealing ring is made of a flexible rubber material, such as foam rubber.

One-piece handle and clip assembly 30 is affixed to the cap 20. The cap is preferably molded around the assembly 30 during formation of the cap, so as to integrally attach the cap and assembly. The assembly 30 includes a loop-shaped handle 31 which extends from the convex surface, and a clip 32 extending from the concave surface. The loop of the handle is sized so as to permit at least one finger to be inserted into the loop for pulling on the handle. Preferably more than one finger can fit within the loop for increased pulling force.

The clip 32 is sized such that it can fit within the key hole 16 of the lock mechanism 14. The clip 32 is also magnetized. Since the lock mechanism is normally made of metal, the attraction force between the magnetized clip 32 and the metallic components of the lock mechanism keeps the clip 32 inside of the key hole 16, and thus secures the device in place. The clip is magnetized to an extent such that the attraction force keeps the device firmly in place during use, but permits a person to remove the device by pulling on the handle 31.

It should be recognized that the handle and clip do not need to be of one-piece construction. A separate handle and clip could be used and appropriately attached to their respective surfaces.

Figure 4:
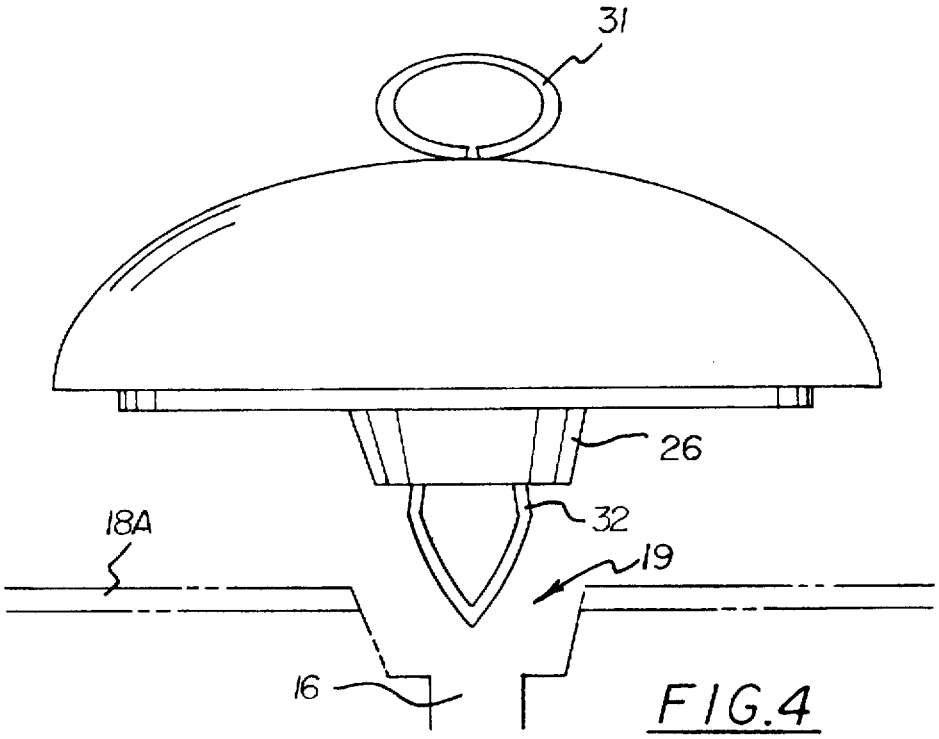
FIG. 4 is a side view of an alternate embodiment of the invention.
Figure 5:
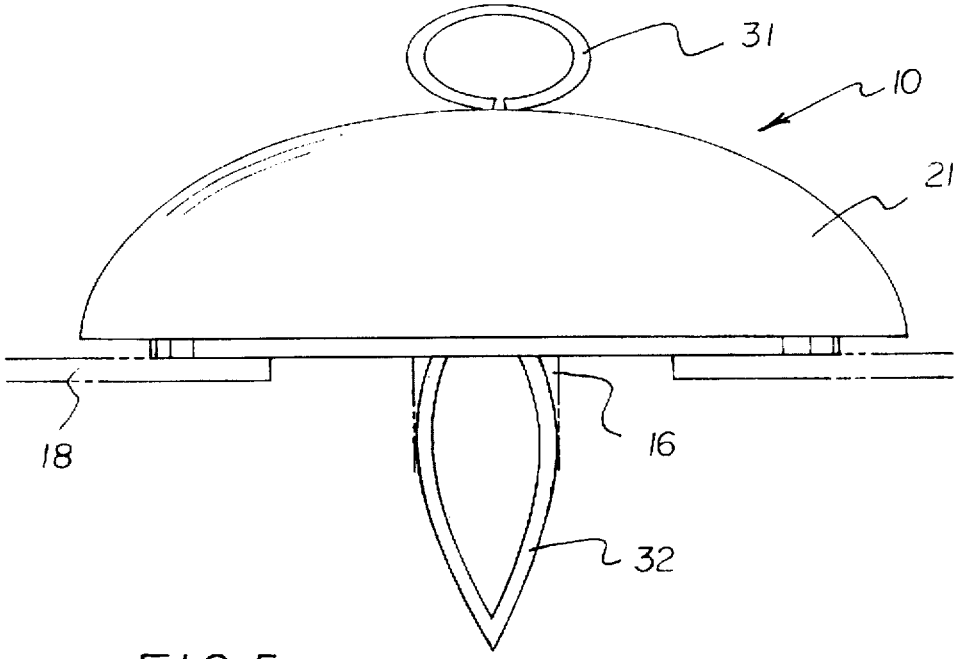
FIG. 5 is a side view of the protection device shown in an operative relationship in a key lock opening.
Figure 6:
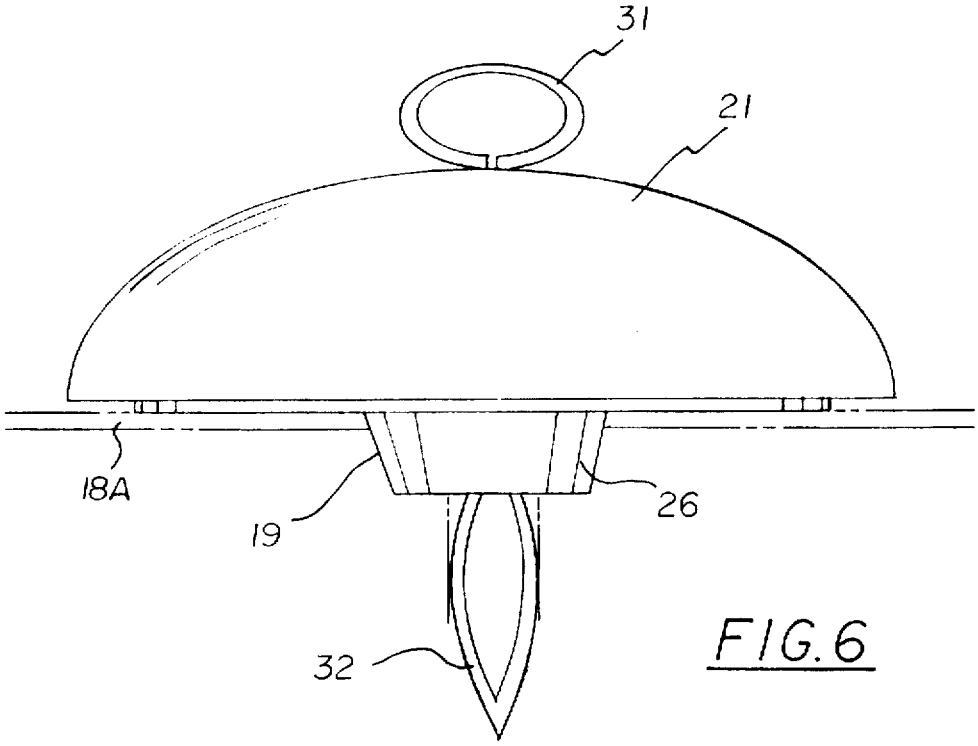
FIG. 6 is a side view of the alternate embodiment of the protection device shown in an operative relationship with a key lock opening.

FIG. 4 shows an alternate embodiment for use with a different type of locking mechanism. Some vehicle panels **18*a* include a recess 19 therein, with the locking mechanism 14 and key hole 16 disposed at the bottom of the recess 19. The recess might cause the clip to fit loosely within the locking mechanism and not be securely engaged. FIG. 4 shows a protection device which is similar in all aspects to the device 10, but it includes a frusto-conically shaped rubber plug 26 which extends from the concave surface of the cap and is molded about the upper end of the clip 32. The plug 26 fits closely within the recess 19** and prevents shifting of the clip and cap due to the recess.

In use, the lock to be protected is chosen and the device is attached by inserting the clip within the key hole. The clip is inserted until the bottom surface 23 contacts the panel 18. The bottom surface of the cap contacting the panel, and the sealing ring 24 engaging the panel, form a series of seals preventing moisture from entering the lock. The magnetic force between the clip and the metallic elements of the lock keeps the device in place. The device is simply removed by grasping the handle 31 and pulling with a force sufficient to overcome the magnetic attraction force.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protection device for a key lock opening proximate to an exterior surface, comprising:

a dome-shaped cap having an exterior convex surface, an interior concave surface, and a bottom surface adapted for engagement with the exterior surface;

a handle extending from the convex surface;

a magnetized clip extending from the concave surface and adapted to be disposed inside of the key lock opening; and a plug extending from the concave surface and surrounding a portion of the clip, said plug adapted to fit within a recess in the exterior surface;

wherein the plug has a frusto-conical shape.

2. The protection device of claim 1, further comprising a seal ring extending from the concave surface for sealing engagement with the exterior surface.

3. The protection device of claim 2, wherein the seal ring extends past the bottom surface of the cap to provide increased sealing.

4. The protection device of claim 2, wherein the seal ring is made of foam rubber.

5. The protection device of claim 1, wherein the cap is rigid.

6. The protection device of claim 5, wherein the cap is made of plastic material.

7. The protection device of claim 1, wherein the handle is loop-shaped.

8. The protection device of claim 1, wherein the handle and the clip are of one-piece construction.

9. The protection device of claim 1, wherein the plug is made of rubber.

10. A protection device for a key lock opening proximate to an exterior surface, comprising:

a rigid, plastic, dome-shaped cap having an exterior convex surface, an interior concave surface, and a bottom surface adapted for engagement with the exterior surface:

a foam rubber seal ring extending from the concave surface and past the bottom surface for sealing engagement with the exterior surface;

a loop-shaped handle extending from the convex surface;

a magnetized clip integrally formed with the handle and extending from the concave surface, and adapted to be disposed inside of the key lock opening; and a rubber plug extending from the concave surface and surrounding a portion of the clip, said plug adapted to fit within a recess in the exterior surface;

wherein the plug has a frusto-conical shape.

* * * * *